US011242765B2

(12) United States Patent
Kim

(10) Patent No.: US 11,242,765 B2
(45) Date of Patent: Feb. 8, 2022

(54) APPARATUS FOR ADJUSTING CLEARANCE AND GAS TURBINE INCLUDING THE SAME

(71) Applicant: DOOSAN HEAVY INDUSTRIES & CONSTRUCTION CO., LTD., Changwon-si (KR)

(72) Inventor: Yeong Chun Kim, Changwon-si (KR)

( * ) Notice: Subject to any disclaimer, the term of this patent is extended or adjusted under 35 U.S.C. 154(b) by 23 days.

(21) Appl. No.: 16/895,241

(22) Filed: Jun. 8, 2020

(65) Prior Publication Data

US 2021/0040863 A1 Feb. 11, 2021

(30) Foreign Application Priority Data

Aug. 8, 2019 (KR) ..... 10-2019-0096858

(51) Int. Cl.
*F01D 11/22* (2006.01)

(52) U.S. Cl.
CPC ..... *F01D 11/22* (2013.01)

(58) Field of Classification Search
CPC ..... F01D 11/22
USPC ..... 415/14, 140
See application file for complete search history.

(56) References Cited

U.S. PATENT DOCUMENTS 5,951,244 A * 9/1999 Knight, Sr. ..... F04D 29/622 415/132
6,368,053 B1 * 4/2002 Knight, Sr. ..... F01D 25/16 411/383
7,168,915 B2 * 1/2007 Doering ..... F04D 7/045 415/121.1
8,449,243 B2 * 5/2013 Fiala ..... F01D 5/066 415/14
2016/0215647 A1 * 7/2016 Smith ..... F01D 11/22

FOREIGN PATENT DOCUMENTS

KR 1020190075465 7/2019

* cited by examiner

*Primary Examiner* — Courtney D Heinle
*Assistant Examiner* — Ryan C Clark
(74) *Attorney, Agent, or Firm* — Harvest IP Law, LLP

(57) ABSTRACT

A clearance adjusting apparatus disposed in front of a compressor of a gas turbine to axially move a compressor disk back and forth to adjust a tip clearance formed between a compressor blade and a compressor casing is provided. The clearance adjusting apparatus includes a hollow fastening part disposed in front of the compressor casing, a shaft disposed in the fastening part and coupled to a front side of the compressor disk, an adjusting part disposed between the fastening part and the shaft to axially move the shaft back and forth to adjust the tip clearance, and a biasing part disposed on the fastening part to bias the adjusting part back and forth to adjust a position of the adjusting part and the shaft.

18 Claims, 12 Drawing Sheets

<B>

APPARATUS FOR ADJUSTING CLEARANCE AND GAS TURBINE INCLUDING THE SAME

CROSS REFERENCE TO RELATED APPLICATION

This application claims priority to Korean Patent Application No. 10-2019-0096858, filed on Aug. 8, 2019, the entire disclosure of which is incorporated herein by reference in its entirety.

BACKGROUND

1. Field

Apparatuses and methods consistent with exemplary embodiments relate to a clearance adjusting apparatus and a gas turbine including the same and, more particularly, to a clearance adjusting apparatus installed in front of a compressor to axially move a rotor of a gas turbine back and forth so that tip clearances formed between blades and casings provided in a compressor section and a turbine section are adjusted, and a gas turbine including the same.

2. Description of the Related Art

A gas turbine is a power engine that mixes air compressed in a compressor with fuel for combustion and rotates a turbine using high-temperature gas produced by the combustion. The gas turbine is used to drive a generator, an aircraft, a ship, a train, etc.

The gas turbine includes a compressor, a combustor, and a turbine. The compressor includes a plurality of compressor vanes and a plurality of compressor blades alternately arranged in a compressor casing with an air inlet through which air is introduced. The introduced air is compressed by the compressor vanes and the compressor blades while passing through an interior of the compressor.

The combustor mixes the compressed air compressed by the compressor with fuel and ignites a fuel-air mixture with an igniter to generate high-temperature and high-pressure combustion gas. The generated combustion gas is supplied to the turbine.

The turbine includes a plurality of turbine vanes and a plurality of turbine blades alternately arranged in a turbine casing. The turbine blades are rotated by the combustion gas to generate power and the combustion gas is discharged to the outside through a turbine diffuser.

A gas turbine does not have a reciprocating mechanism such as a piston which is usually provided in a typical four-stroke engine. The gas turbine has no mutual friction portion such as a piston-cylinder, thereby having the advantages that consumption of lubricant is extremely low and an operational stroke which is relatively long in common reciprocating mechanisms is reduced. Therefore, the gas turbine has an advantage of high operation speed, thereby generating high-capacity power.

FIG. 1 is a perspective view illustrating a related art clearance adjusting apparatus. Referring to FIG. 1, a gas turbine includes a clearance adjusting apparatus 10*x*. The clearance adjusting apparatus 10*x* is installed in front of a compressor 1 to axially move a compressor disk 121 back and forth so that a tip clearance formed between compressor blades 122 and a compressor casing 111 is adjusted. Because the compressor disk 121 is also connected to a turbine disk, the clearance adjusting apparatus 10*x* adjusts a tip clearance of the turbine at the same time.

The clearance adjusting apparatus 10*x* includes a shaft 11*x*, a thrust bearing 12*x*, a thrust collar 13*x*, an adjusting part 14*x*, and a fastening part 15*x*. The shaft 11*x* is coupled to a front side of the compressor disk 121. The adjusting part 14*x* is disposed around an outer circumferential surface of the shaft 11*x* such that the shaft 11*x* can be slidably moved back and forth along the adjusting part 14*x*. The thrust bearing 12*x* and the thrust collar 13*x* are disposed to be movable back and forth in the adjusting part 14*x*. The adjusting part 14*x* adjusts the tip clearance by biasing and moving the thrust bearing 12*x* and the thrust collar 13*x* back and forth. The fastening part 15*x* is fixed to a protruding member 112 of the compressor 1 at one side and is fixedly installed on the outer circumferential surface of the adjusting part 14*x* at the other side.

The related art clearance adjusting apparatus 10*x* has an initial installation position to be adjusted based on a gap G formed between the protruding member 112 and the compressor disk 121 when initially installed on the compressor 1. If an error occurs when installing the related art clearance adjusting apparatus 10*x* based on the gap G, a shim plate 20*x* is inserted between the fastening part 15*x* and the protruding member 112 to correct an initial installation error.

According to the related art clearance adjusting apparatus 10*x*, in order to insert the shim plate 20*x*, it is required to disassemble the fastening part 15*x*, the adjusting part 14*x*, and the thrust bearing 12*x* from the shaft 11*x*, insert the shim plate 20*x*, and then reassemble the fastening part 15*x*, the adjusting part 14*x*, and the thrust bearing 12*x*. However, according to the related art clearance adjusting apparatus 10*x*, problems arise in that not only a process of correcting an initial installation position is very complicated, but also a process of correcting the initial installation error takes an excessive amount of time and cost.

SUMMARY

Aspects of one or more exemplary embodiments provide a clearance adjusting apparatus capable of correcting an error generated with respect to an initial installation position and a gas turbine including the same.

Additional aspects will be set forth in part in the description which follows and, in part, will become apparent from the description, or may be learned by practice of the exemplary embodiments.

According to an aspect of an exemplary embodiment, there is provided a clearance adjusting apparatus disposed in front of a compressor of a gas turbine to axially move a compressor disk back and forth to adjust a tip clearance formed between a compressor blade and a compressor casing, the clearance adjusting apparatus including: a hollow fastening part disposed in front of the compressor casing; a shaft disposed in the fastening part and coupled to a front side of the compressor disk; an adjusting part disposed between the fastening part and the shaft to axially move the shaft back and forth to adjust the tip clearance; and a biasing part disposed on the fastening part to bias the adjusting part back and forth to adjust a position of the adjusting part and the shaft.

A protruding member may be formed to protrude radially inward from an inner circumferential surface of a front side of the compressor casing, wherein the fastening part may include: a fastening housing installed around an outer circumferential surface of the adjusting part; a fastening member disposed on a rear end of the fastening housing to be fixed to the protruding member; and a fastening step disposed on an inner circumferential surface of the fastening housing, and the biasing part may be disposed on the fastening step to bias the adjusting part back and forth so that the adjusting part and the shaft are moved back and forth.

A gap may be formed between the protruding member and the compressor disk in an axial direction of the compressor disk, wherein the biasing part may be configured to adjust a position of the adjusting part and the shaft by biasing the adjusting part rearward if the gap is less than a preset reference range and biasing the adjusting part forward if the gap exceeds the preset reference range.

The fastening step may include a pair of fastening step portions spaced apart back and forth from each other, the adjusting part may be disposed between the pair of fastening step portions, and the biasing part may include a pair of biasing members disposed to penetrate through the pair of fastening step portions from an outside toward an inside of the pair of the fastening step portions, respectively, in an axial direction thereof to bias and move the adjusting part forward or rearward.

The pair of biasing members may be disposed to be movable back and forth with respect to the pair of fastening step portions, respectively, such that respective distal ends thereof comes into contact with front and rear surfaces of the adjusting part, wherein if one of the biasing members is moved toward and biases the adjusting part, the other biasing member may be moved away from the adjusting part.

Each of the pair of fastening step portions may include through-holes having a threaded portion on an inner wall thereof such that the pair of biasing members penetrate therethrough, and the pair of biasing members may include a threaded portion to be meshed with the threaded portion of the through-hole on an outer circumferential surface thereof with, so that the pair of biasing members rotate and move back and forth through the pair of fastening step portions, respectively.

The adjusting part may include a pair of insertion holes into which distal ends of the pair of biasing members are respectively inserted, and a threaded portion may be formed on an inner wall of the through-hole, wherein the pair of biasing members which are rotatable at a fixed position with respect to the pair of fastening step portions include a threaded portion corresponding to the threaded portion of the pair of the insertion holes on an outer circumferential surface of the distal end side thereof, such that if one of the biasing members is screwed into one of the insertion holes, the other biasing member may be unscrewed out of the other insertion hole.

The pair of fastening step portions may include a first fastening step portion disposed on a rear side of an axial thrust direction based on the adjusting part and a second fastening step portion disposed on a front side of the thrust direction based on the adjusting part, the adjusting part being subjected to an axial thrust with a fluid flowing through the gas turbine, and the pair of biasing members may include a first biasing member attached to the first fastening step portion and a second biasing member attached to the second fastening step portion, wherein the biasing part may further include a washer member fitted around the first biasing member between the adjusting part and the first fastening step portion.

The adjusting part may include an insertion hole into which a distal end of the first biasing member is inserted, and a threaded portion may be formed on an inner wall of the through-hole, wherein the first biasing member which is rotatable at a fixed position with respect to the first fastening step portion may include a threaded portion corresponding to the threaded portion of the insertion hole on an outer circumferential surface of the distal end side thereof, wherein the second biasing member may be movable back and forth with respect to the second fastening step portion such that a distal end thereof is arranged to contact the adjusting part, and wherein if the second biasing member is moved toward and biases the adjusting part, the first biasing member may be screwed into the insertion hole, and if the second biasing member is moved away from the adjusting part, the first biasing member may be unscrewed out of the insertion hole.

The fastening part may further include a reinforcing housing disposed between the fastening housing and the adjusting part, and a reinforcing protrusion protruding from an outer circumferential surface of the reinforcing housing to be inserted into an inner circumferential surface of the fastening housing, wherein the fastening step may be formed to protrude from an inner circumferential surface of the reinforcing housing.

According to an aspect of another exemplary embodiment, there is provided a gas turbine including: a compressor including a compressor casing along which an externally introduced air flows, a compressor stator coupled to an inner circumferential surface of the compressor casing and having compressor vanes disposed in a multi-stage along a flow direction of the air, and a compressor rotor having a compressor disk disposed inside the compressor casing and compressor blades coupled to an outer circumferential surface of the compressor disk such that the compressor blades are disposed between the compressor vanes to rotate; a combustor configured to mix the compressed air supplied from the compressor with fuel and combust the air-fuel mixture; a turbine including a turbine stator through which the combustion gas supplied from the combustor flows and a turbine rotor disposed in the turbine stator to rotate with the combustion gas flowing therethrough; and a clearance adjusting apparatus disposed in front of the compressor to axially move the compressor disk back and forth to adjust a tip clearance formed between the compressor blade and the compressor casing d, the clearance adjusting apparatus including: a hollow fastening part disposed in front of the compressor casing; a shaft disposed in the fastening part and coupled to a front side of the compressor disk; an adjusting part disposed between the fastening part and the shaft to axially move the shaft back and forth to adjust the tip clearance; and a biasing part disposed on the fastening part to bias the adjusting part back and forth to adjust a position of the adjusting part and the shaft.

A protruding member may be formed to protrude radially inward from an inner circumferential surface of a front side of the compressor casing, wherein the fastening part may include: a fastening housing installed around an outer circumferential surface of the adjusting part; a fastening member disposed on a rear end of the fastening housing to be fixed to the protruding member; and a fastening step disposed on an inner circumferential surface of the fastening housing, wherein the biasing part may be disposed on the fastening step to bias the adjusting part back and forth so that the adjusting part and the shaft are moved back and forth.

A gap may be formed between the protruding member and the compressor disk in an axial direction of the compressor disk, wherein the biasing part may be configured to adjust a position of the adjusting part and the shaft by biasing the adjusting part rearward if the gap is less than a preset reference range and biasing the adjusting part forward if the gap exceeds the preset reference range.

The fastening step may include a pair of fastening step portions spaced apart back and forth from each other, wherein the adjusting part may be disposed between the pair of fastening step portions, wherein the biasing part may include a pair of biasing members disposed to penetrate through the pair of fastening step portions from an outside toward an inside of the pair of the fastening step portions, respectively, in an axial direction thereof to bias and move the adjusting part forward or rearward.

The pair of biasing members may be disposed to be movable back and forth with respect to the pair of fastening step portions, respectively, such that respective distal ends thereof comes into contact with front and rear surfaces of the adjusting part, wherein if one of the biasing members is moved toward and biases the adjusting part, the other biasing member may be moved away from the adjusting part.

Each of the pair of fastening step portions may include through-holes having a threaded portion on an inner wall thereof such that the pair of biasing members penetrate therethrough, wherein the pair of biasing members may include a threaded portion to be meshed with the threaded portion of the through-hole on an outer circumferential surface thereof, so that the pair of biasing members rotate and move back and forth through the pair of fastening step portions, respectively.

The adjusting part may include a pair of insertion holes into which distal ends of the pair of biasing members are respectively inserted, and a threaded portion may be formed on an inner wall of the through-hole, wherein the pair of biasing members which are rotatable at a fixed position with respect to the pair of fastening step portions may include a threaded portion corresponding to the threaded portion of the pair of the insertion holes on an outer circumferential surface of the distal end side thereof, such that if one of the biasing members is screwed into one of the insertion holes, the other biasing member may be unscrewed out of the other insertion hole.

The fastening step portions may include a first fastening step portion disposed on a rear side of an axial thrust direction based on the adjusting part and a second fastening step portion disposed on a front side of the thrust direction based on the adjusting part, the adjusting part being subjected to an axial thrust with a fluid flowing through the gas turbine, and the pair of biasing members include a first biasing member attached to the first fastening step portion and a second biasing member attached to the second fastening step portion, wherein the biasing part may further include a washer member fitted around the first biasing member between the adjusting part and the first fastening step portion.

The adjusting part may include an insertion hole into which a distal end of the first biasing member is inserted, and a threaded portion may be formed on an inner wall of the through-hole, wherein the first biasing member which is rotatable at a fixed position with respect to the first fastening step portion may include a threaded portion corresponding to the threaded portion of the insertion hole on an outer circumferential surface of the distal end side thereof, wherein the second biasing member may be movable back and forth with respect to the second fastening step portion such that a distal end thereof is arranged to contact the adjusting part, and wherein if the second biasing member is moved toward and biases the adjusting part, the first biasing member may be screwed into the insertion hole, and if the second biasing member is moved away from the adjusting part, the first biasing member may be unscrewed out of the insertion hole.

The fastening part may further include a reinforcing housing disposed between the fastening housing and the adjusting part, and a reinforcing protrusion protruding from an outer circumferential surface of the reinforcing housing to be inserted into an inner circumferential surface of the fastening housing, wherein the fastening step may be formed to protrude from an inner circumferential surface of the reinforcing housing.

In the clearance adjusting apparatus and the gas turbine having the same according to one or more exemplary embodiments, the biasing part is provided to move the adjusting part back and forth with respect to the fastening part so that the adjusting part and the shaft are moved back and forth, thereby correcting an initial installation position error. Therefore, the initial installation position error can be easily corrected without separate disassembly and reassembly of the parts.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
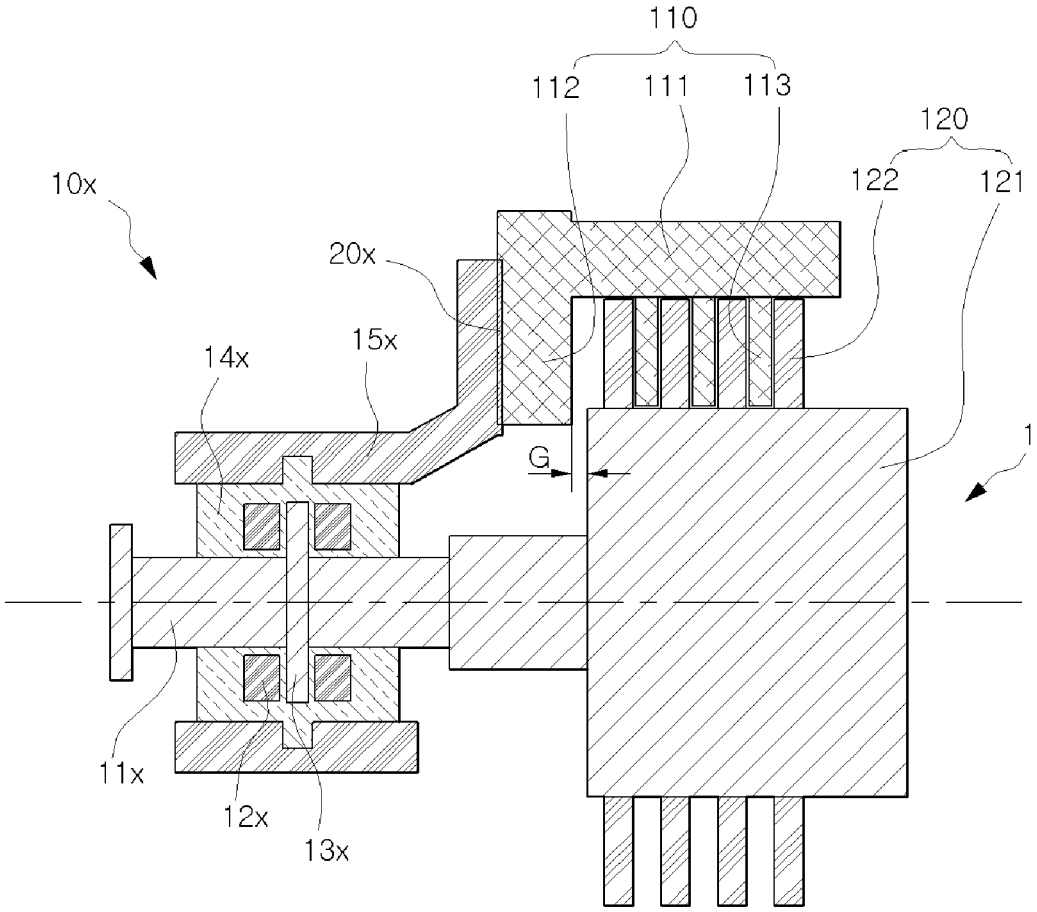
FIG. 1 is a perspective view illustrating a related art clearance adjusting apparatus.

Various modifications may be made to the embodiments of the disclosure, and there may be various types of embodiments. Thus, specific embodiments will be illustrated in drawings, and embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well, unless the context clearly indicates otherwise.

In this specification, terms such as "comprise", "include", or "have/has" should be construed as designating that there are such features, integers, steps, operations, elements, components, and/or a combination thereof in the specification, not to exclude the presence or possibility of adding one or more of other features, integers, steps, operations, elements, components, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a clearance adjusting apparatus and a gas turbine including the same according to one or more exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

Figure 2:
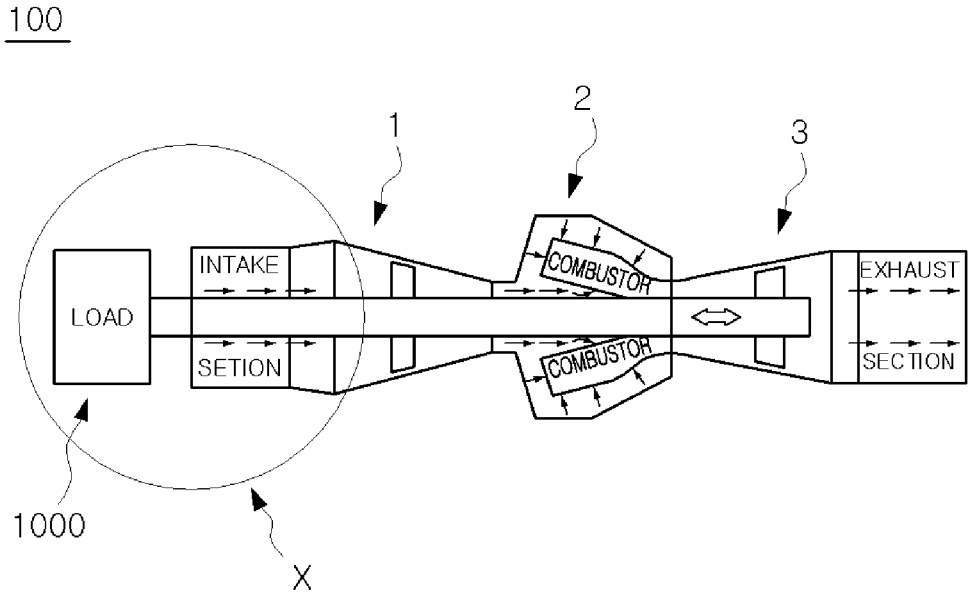
FIG. 2 is a view illustrating a gas turbine according to a first exemplary embodiment.

FIG. 2 is a view illustrating a gas turbine according to a first exemplary embodiment. Referring to FIG. 2, the gas turbine 100 includes a compressor 1, a combustor 2, a turbine 3, and a clearance adjusting apparatus 1000. Based on an axial direction, the turbine 3 is disposed on a rear side of the compressor 1, and the combustor 2 is disposed between the compressor 1 and the turbine 3. The clearance adjusting apparatus 1000 is installed in front of the compressor 1.

The compressor 1 includes compressor vanes and a compressor rotor including a compressor disk and compressor blades in a compressor casing. The turbine 2 includes turbine vanes and a turbine rotor including a turbine disk and turbine blades in a turbine casing. The compressor vanes and the compressor blades are arranged in a multi-stage along a flow direction of compressed air, and the turbine vanes and the turbine blades are also arranged in a multi-stage along a flow direction of combustion gas. The compressor has an internal space of which volume decreases from a front-stage toward a rear-stage so that the introduced air can be compressed. In contrast, the turbine has an internal space of which volume increases from a front-stage toward a rear-stage so that the combustion gas can expand.

The plurality of compressor blades are radially coupled to an outer circumferential surface of the compressor disk in the multi-stage. Further, the plurality of compressor vanes are arranged in the multi-stage on an inner circumferential surface of the compressor casing such that each stage of compressor vanes is disposed between adjacent stages of compressor blades. While the compressor rotor disks rotate along with a rotation of a tie rod, the compressor vanes fixed to the compressor casing do not rotate. The compressor vanes guide the flow of the compressed air moved from front-stage compressor blades to rear-stage compressor blades. Here, the compressor casing and the compressor vanes may be defined as a compressor stator to distinguish them from the compressor rotor.

The combustor 3 mixes the introduced compressed air with fuel and combusts the air-fuel mixture to produce high-temperature and high-pressure combustion gas with high energy, thereby raising the temperature of the combustion gas to a temperature at which the combustor and the turbine are able to be resistant to heat through an isothermal combustion process.

A plurality of combustors constituting the combustor 3 may be arranged in a form of a cell in a combustor casing. Each combustor includes a nozzle for injecting fuel, a liner defining a combustion chamber, and a transition piece serving as a connector between the combustor and the turbine.

The liner provides a combustion space in which fuel injected from a fuel nozzle is mixed with the compressed air supplied from the compressor and burned. The liner includes a combustion chamber that provides the combustion space in which the fuel air mixture is burned, and an annular flow path that surrounds the combustion chamber to provide an annular space. The fuel injection nozzle is coupled to a front side of the liner, and an igniter is coupled to a sidewall of the liner.

In the annular flow path, the compressed air introduced through a plurality of holes provided in an outer wall of the liner flows, and the compressed air that cooled the transition piece also flows. Therefore, as the compressed air flows along the outer wall of the liner, it is possible to prevent the liner from being thermally damaged by high temperature combustion gas.

The transition piece is connected to a rear side of the liner to deliver the combustion gas toward the turbine. The transition piece includes an annular flow path surrounding an inner space of the transition piece. As the compressed air flows along the annular flow path, an outer wall of the transition piece is cooled by the compressed air to prevent damage by high temperature combustion gas.

Meanwhile, the high-temperature and high-pressure combustion gas is supplied to the turbine. The high-temperature and high-pressure combustion gas supplied to the turbine expands while passing through an inside of the turbine, and applies impulses and reaction forces to turbine blades to generate rotational torque. The obtained rotational torque is transmitted to the compressor through a shaft of the gas turbine, and an excess portion thereof exceeding the power required to drive the compressor is used to drive a generator or the like.

Figure 3:
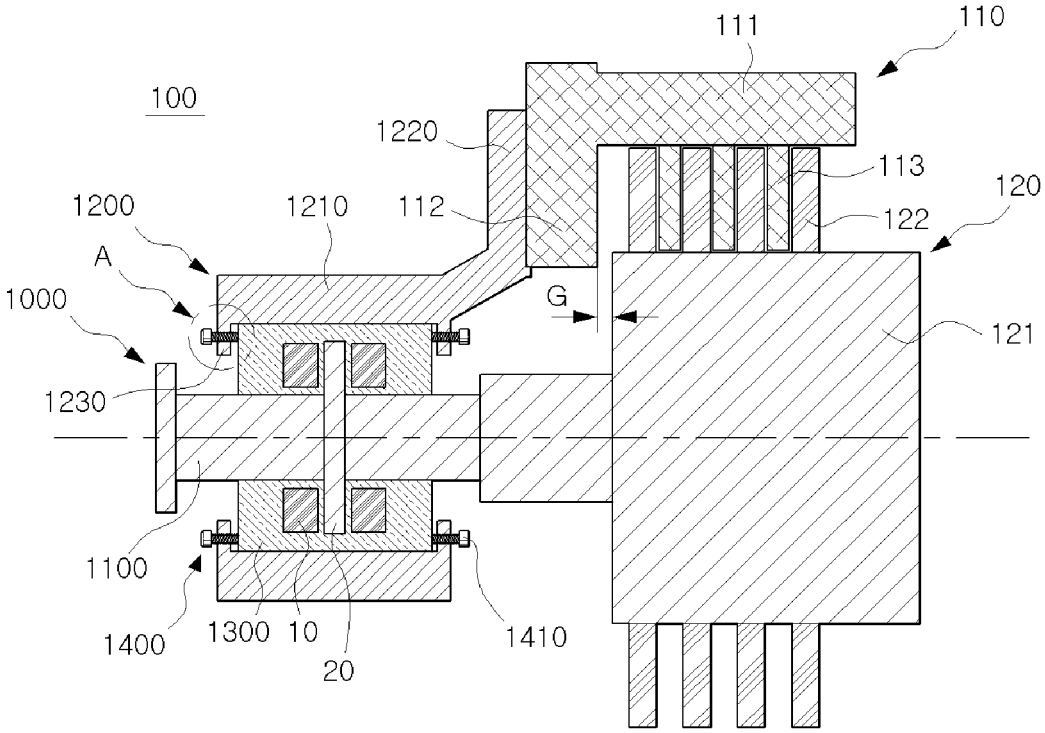
FIG. 3 is an enlarged view of a portion X of FIG. 2.
Figure 4:
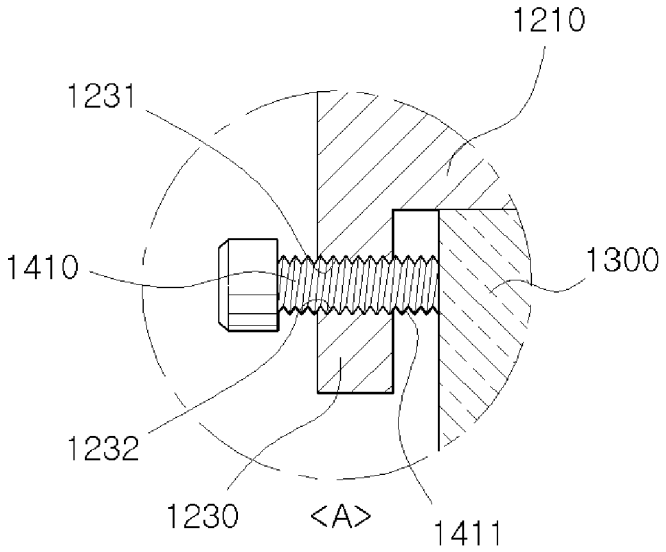
FIG. 4 is an enlarged view of a portion A of FIG. 3.

Hereinafter, a clearance adjusting apparatus according to a first exemplary embodiment and a gas turbine including the same will be described in detail with reference to FIGS. 3 and 4. FIG. 3 is an enlarged view of a portion X of FIG. 2, and FIG. 4 is an enlarged view of a portion A of FIG. 3.

Referring to FIG. 3, the clearance adjusting apparatus 1000 is installed in front of the compressor. The compressor includes a compressor stator 110 and a compressor rotor 120. The compressor stator 110 includes a hollow cylindrical compressor casing 111, a protruding member 112 protruding radially inward from an inner circumferential surface of a front side of the compressor casing 111, and compressor vanes 113 arranged in a multi-stage along an axial direction of the compressor casing 111. The compressor rotor 120 includes a compressor disk 121 arranged on an inner circumferential surface of the compressor casing 111, and a compressor blades 122 disposed in a multi-stage on an outer circumferential surface of the compressor disk 121 between adjacent stages of compressor vanes 113.

The clearance adjusting apparatus 1000 is disposed in front of the compressor disk 121 and the compressor casing 111 to axially move the compressor disk 121 back and forth so that a tip clearance formed between the compressor blades 122 and the compressor casing 111 is adjusted. Here, because the compressor disk 121 is also connected to a turbine disk of the turbine 3, the axial back-forth movement of the compressor disk 121 causes the axial back-forth movement of the turbine disk of the turbine 3 at the same time. Therefore, the clearance adjusting apparatus 1000 is designed to adjust the tip clearance of the compressor land the tip clearance of the turbine 3.

To this end, the clearance adjusting apparatus 1000 includes a shaft 1100, a fastening part 1200, an adjusting part 1300, and a biasing part 1400.

The shaft 1100 is disposed on a front side of the compressor disk 121 parallel with a central axis of the compressor disk 121.

The fastening part 1200 is circumferentially spaced apart from and disposed around the shaft 1100 such that the fastening part 1200 is fixedly coupled to a front surface of the protruding member 112. The fastening part 1200 includes a fastening housing 1210, a fastening member 1220, and a pair of fastening steps 1230. The fastening housing 1210 is a hollow cylindrical member of which inner circumferential surface is disposed to be circumferentially spaced apart from an outer circumferential surface of the shaft 1100. The fastening member 1220 is coupled to a rear end of the fastening housing 1210 and is fixed to a front surface of the protruding member 112. Accordingly, the fastening part 1200 cannot be moved in a back-forth direction (i.e., an axial direction of the shaft 1100 and the compressor disk 121), but is disposed at a fixed position. The pair of fastening steps 1230 are formed to protrude radially inward from an inner circumferential surface of the fastening housing 1210. In addition, the fastening steps 1230 are arranged to be spaced apart from each other in the axial direction. Referring to FIG. 4, each of the fastening steps 1230 includes a through-hole 1231 extending in the axial direction. Further, an inner wall of the through-hole 1231 is provided with a threaded portion 1232.

The adjusting part 1300 is disposed between the shaft 1100 and the fastening housing 1210. In addition, the adjusting part 1300 is disposed between the pair of fastening steps 1230. The shaft 1100 internally disposed around the adjusting part 1300 is slidable back and forth along the adjusting part 1300. In addition, a thrust bearing 10 and a thrust collar 20 are installed inside the adjusting part 1300. The thrust bearing 10 allows the shaft 1100 and the adjusting part 1300 to be rotatably installed with respect to the fastening part 1200. The thrust collar 20 protrudes from the outer circumferential surface of the shaft 1100. When the adjusting part 1300 biases the thrust bearing 10 and the thrust collar 20 back and forth, the shaft 1100 and the compressor disk 121 also move back and forth. Accordingly, the adjusting part 1300 adjusts the tip clearances of the compressor 1 and the turbine 3.

The adjusting part 1300 is installed to be slidable back and forth with respect to the fastening housing 1210. Therefore, as the adjusting part 1300 is biased back and forth by the biasing part 1400, the adjusting part 1300 moves back and forth together with the shaft 1100 and the compressor disk 121. The clearance adjusting apparatus 1000 has two types of sliding structures. The first structure is such that the thrust bearing 10, the thrust collar 20, the shaft 1100, and the compressor disk 121 are moved back and forth by the adjusting part 1300. The second structure is such that the adjusting part 1300, the thrust bearing 10, the thrust collar 20, the shaft 1100, and the compressor disk 121 are moved back and forth by the biasing part 1400. The first structure is for adjusting the tip clearances of the compressor 1 and the turbine 3, and the second structure is for correcting an initial installation error of the clearance adjusting apparatus 1000.

The biasing part 1400 biases and moves the adjusting part 1300 back and forth while supporting the adjusting part 1300 with respect to the fastening part 1200. To this end, the biasing part 1400 includes a pair of biasing members 1410. The pair of biasing members 1410 are installed to axially penetrate through the pair of fastening steps 1230, respectively, from the outside toward the inside of the pair of fastening steps 1230. That is, in the pair of biasing members 1410, a front side biasing member is disposed to penetrate through a front side fastening step of the pair of fastening steps 1230 from the front side toward the rear side, and a rear side biasing member is disposed to penetrate through a rear side fastening step of the pair of fastening steps 1230 from the rear side toward the front side.

Referring to FIG. 4, the biasing member 1410 is provided on an outer circumferential surface thereof with a threaded portion 1411 to be meshed with the threaded portion 1232 of the through-hole 1231. Thus, the biasing member 1410 is screwed through the through-hole 1231 back and forth, so that the biasing member 1410 moves back and forth with respect to the fastening step 1230. In addition, when completely coupled, the pair of biasing members 1410 are disposed such that distal ends of the front and rear side biasing members come into contact with front and rear surfaces of the adjusting part 1300, respectively.

Meanwhile, a gap G is formed between the protruding member 112 and the compressor disk 121 in the axial direction of the compressor disk 121.

In addition, the biasing part 1400 serves to correct an initial installation error of the clearance adjusting apparatus 1000 with respect to the gap G. That is, the biasing part 1400 is operable to perform a rearward biasing action if the gap G is less than a preset reference range and to perform a forward biasing action if the gap G exceeds the preset reference range. Accordingly, the biasing part 1400 serves to adjust a position of the adjusting part 1300 and the shaft 1100.

When a user tries to move the compressor disk 121 forward, the front side and rear side biasing members 1410 are screwed in the forward direction. When the front side biasing member 1410 is screwed forward, a clearance is formed between a distal end of the front side biasing member 1410 and the front surface of the adjusting part 1300. When the rear side biasing member 1410 is screwed forward, the adjusting part 1300 is biased and moved forward a distance corresponding to the clearance by the rear side biasing member 1410. The shaft 1100 and the compressor disk 121 are also moved forward together with the adjusting part 1300.

When a user tries to move the compressor disk 121 rearward, the front side and rear side biasing members 1410 are screwed in the rearward direction. When the rear side biasing member 1410 is screwed rearward, a clearance is formed between a distal end of the rear side biasing member 1410 and the rear surface of the adjusting part 1300. When the front side biasing member 1410 biases the adjusting part 1300 rearward, the adjusting part 1300 is moved rearward a distance corresponding to the clearance. Thus, the shaft 1100 and the compressor disk 121 are also moved rearward together with the adjusting part 1300.

As described above, in the clearance adjusting apparatus 1000 and the gas turbine 100 having the same according to the exemplary embodiment, the adjusting part 1300 is designed to be slidable back and forth with respect to the fastening part 1200, and the biasing part 1400 is provided to bias the adjusting part 1300 back and forth with respect to the fastening part 1200, thereby correcting an initial installation position error based on the gap G formed between the protruding member 112 and the compressor disk 121. Therefore, according to the clearance adjusting apparatus 1000 and the gas turbine 100 including the same, the initial installation position error can be easily corrected without separate disassembly and reassembly of parts.

Figure 5:
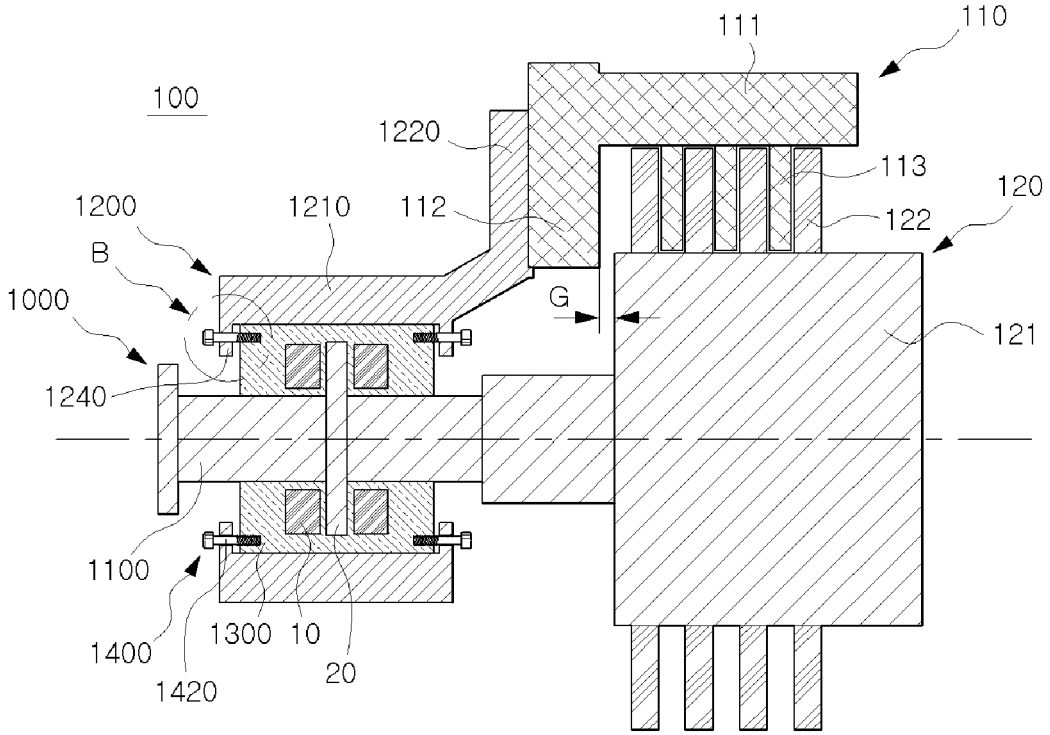
FIG. 5 is a view illustrating a gas turbine according to a second exemplary embodiment.
Figure 6:
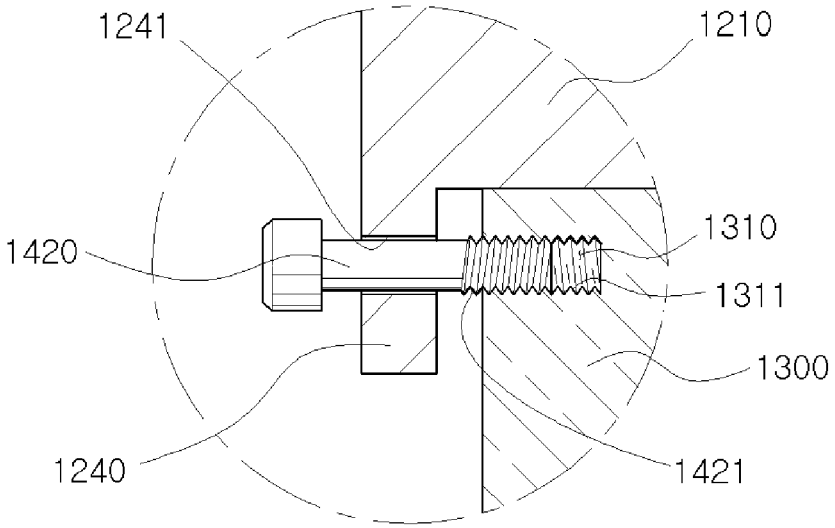
FIG. 6 is an enlarged view of a portion B of FIG. 5.
Figure 7:
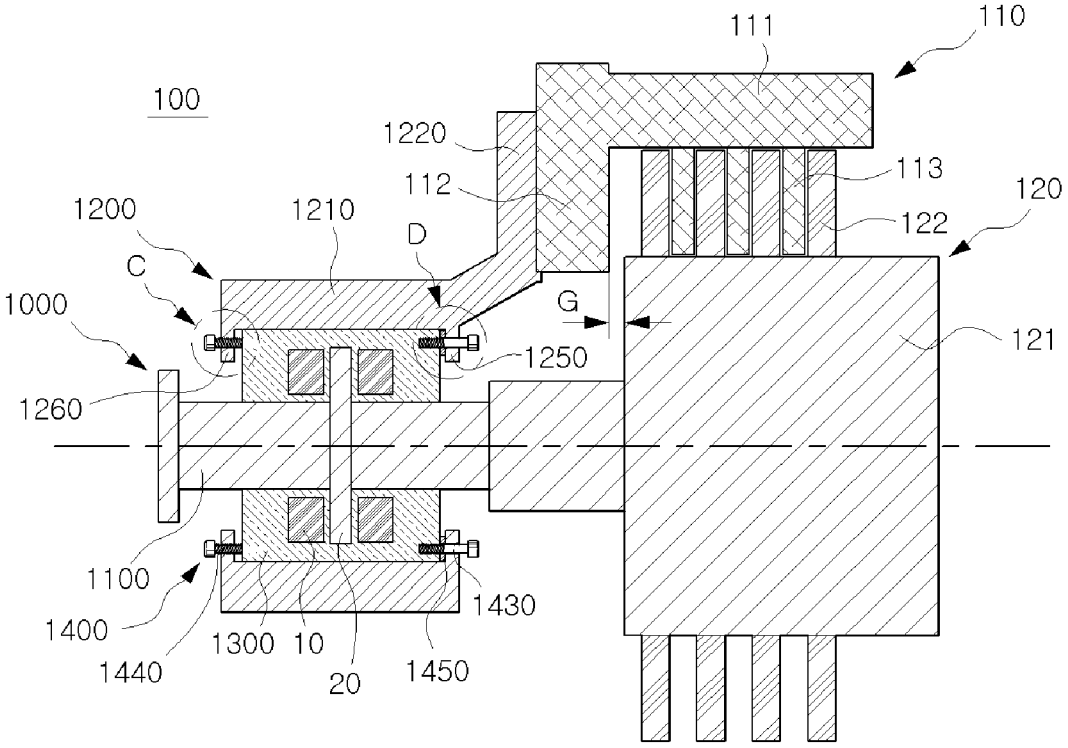
FIG. 7 is a view illustrating a gas turbine according to a third exemplary embodiment.
Figure 8A:
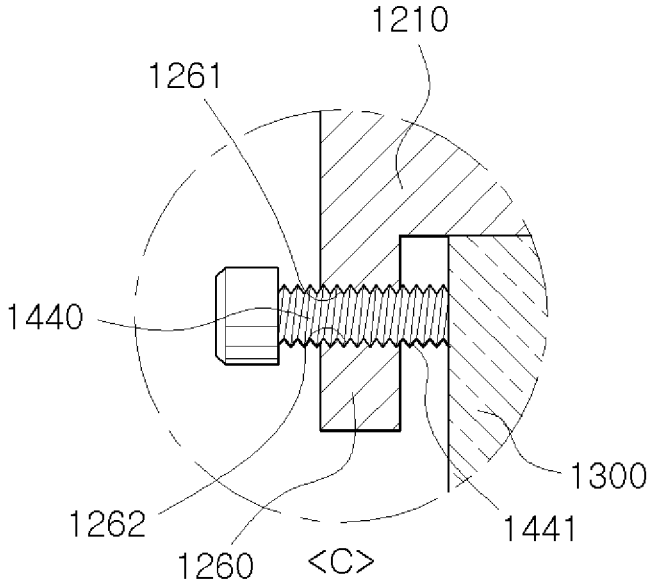
FIGS. 8A and 8B are enlarged views of portions C and D of FIG. 7.
Figure 8B:
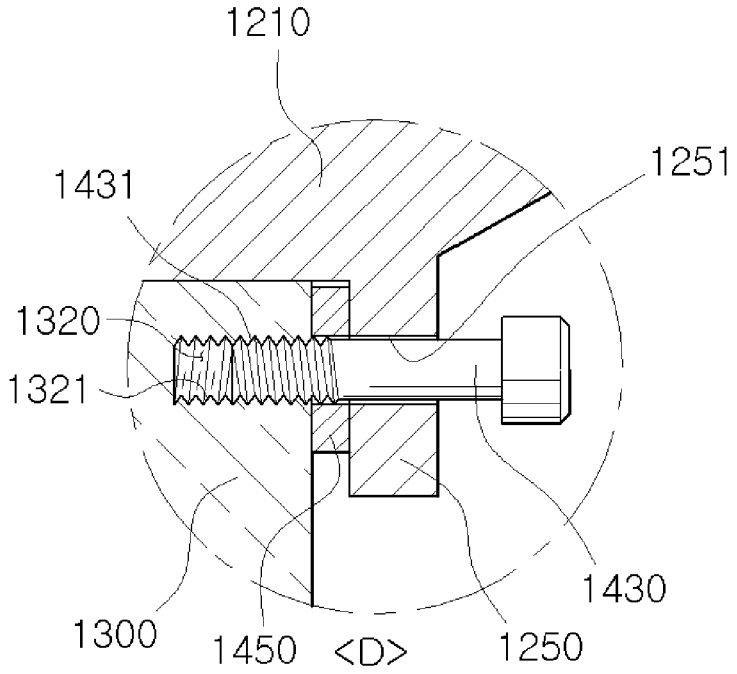

FIG. 5 is a view illustrating a gas turbine according to a second exemplary embodiment, FIG. 6 is an enlarged view of a portion B of FIG. 5, FIG. 7 is a view illustrating a gas turbine according to a third exemplary embodiment, and FIGS. 8A and 8B are enlarged views of portions C and D of FIG. 7. Here, only parts that are different from the first exemplary embodiment will be described.

Referring to FIGS. 5 and 6, the adjusting part 1300 includes insertion holes 1310 (i.e., blind holes) in the front and rear surfaces. Further, a threaded portion 1311 is formed on an inner wall of the insertion hole 1310. The pair of biasing members 1420 is provided on outer circumferential surfaces of distal end sides thereof with threaded portions 1421 to be meshed with the threaded portions 1311 of the insertion holes 1310. Accordingly, the biasing member 1420 is provided such that the distal end side thereof is screwed into the adjusting part 1300.

At this time, through-holes 1241 of the pair of fastening steps 1240 are formed in the axial direction, without threaded portions being separately formed on inner walls of the through-holes 1241. In addition, the pair of biasing members 1420 are provided to be rotatable at a fixed position with respect to the pair of fastening steps 1240. That is, the pair of biasing members 1420 are provided so that it can only rotate in place.

When a user tries to move the compressor disk 121 forward, the front side biasing member of the pair of biasing members 1420 is screwed into the insertion hole 1310, and the rear side biasing member of the pair of biasing members 1420 is unscrewed out of the insertion hole 1310. Although screwing the front side biasing member 1420 originally causes itself to be moved toward and inserted into the adjusting part 1300, because the front side biasing member 1420 is disposed through the front side fastening step 1240 at a fixed position, instead of the front side biasing member 1420, the adjusting part 1300 is biased and moved forward. Similarly, although unscrewing the rear side biasing member 1420 originally causes itself to be moved away from the adjusting part 1300, because the rear side biasing member 1420 is disposed through the rear side fastening step 1240 at a fixed position, instead of the rear side biasing member 1420, the adjusting part 1300 is biased and moved forward. Accordingly, the shaft 1100 and the compressor disk 121 are also moved forward together with the adjusting part 1300.

The rearward movement of the compressor disk 121 may be performed in reverse of the forward movement process. That is, the rear side biasing member 1420 is screwed into the insertion hole 1310, and the front side biasing member 1420 is unscrewed out of the insertion hole 1310. In this case, the adjusting part 1300 is biased and moved rearward, and thus the shaft 1100 and the compressor disk 121 are also moved rearward together with the adjusting part 1300.

Referring to FIGS. 7, 8A, and 8B, the compressor disk 121, the compressor blades 122, the shaft 1100, and the adjusting part 1300 are subjected to an axial thrust with a compressed air flowing through the compressor 1 and a combustion gas flowing through the turbine 3. Although the axial thrust may act forward or rearward, it is assumed that the axial thrust acts rearward.

For a pair of fastening steps 1250 and 1260, a fastening step that is disposed on a rear side of the thrust direction based on the adjusting part 1300 is referred to as a first fastening step 1250, and a fastening step that is disposed on a front side of the thrust direction based on the adjusting part 1300 is referred to as a second fastening step 1260. In addition, for a pair of biasing members 1430 and 1440, a biasing member that is attached to the first fastening step 1250 is referred to as a first biasing member 1430, and a biasing member that is attached to the second fastening step 1260 is referred to as a second biasing member 1440.

The biasing part 1400 further includes a washer member 1450. The washer member 1450 is fitted around the first biasing member 1430 between the adjusting part 1300 and the first fastening step 1250. Accordingly, the washer member 1450 prevents the rear surface of the adjusting part 1300 from directly biasing the first fastening step 1250 along the thrust direction.

The adjusting part 1300 is provided in a rear surface thereof with an insertion hole 1320 (i.e., a blind hole) into which a distal end side of the first biasing member 1430 is inserted, and a threaded portion 1321 is formed on an inner wall of the insertion hole 1320. The first biasing member 1430 is provided on an outer circumferential surface of a distal end side thereof with a threaded portion 1431 to be meshed with the threaded portion 1321 of the insertion holes 1320. Here, a through-hole 1251 of the first fastening step 1250, through which the first biasing member 1430 penetrates, is not provided with a separate threaded portion on an inner wall thereof. Thus, the first biasing member 1430 is provided to be rotatable at a fixed position with respect to the first fastening step 1250.

The second fastening step 1260 includes a through-hole 1261 extending in the axial direction, and a threaded portion 1262 is formed on an inner wall of the through-hole 1261. The second biasing member 1440 is provided on an outer circumferential surface thereof with a threaded portion 1441 to be meshed with the threaded portion 1262 of the through-hole 1261. Therefore, the second biasing member 1440 is axially screwed or unscrewed through the second fastening step 1260. The second biasing member 1440 and the second fastening step 1260 are configured such that a distal end of the second biasing member 1440 comes into contact with the front surface of the adjusting part 1300, instead of being inserted into the adjusting part 1300.

When a user tries to move the compressor disk 121 forward, the second biasing member 1440 is unscrewed in the forward direction, i.e., in a direction away from the adjusting part 1300. In this case, as the second biasing member 1440 is unscrewed forward, a clearance is formed between the distal end thereof and the front surface of the adjusting part 1300. In addition, the first biasing member 1430 biases the adjusting part 1300 forward. Accordingly, the adjusting part 1300 is biased and moved forward a distance corresponding to the clearance by the first biasing member 1430. Further, the shaft 1100 and the compressor disk 121 are also moved forward together with the adjusting part 1300.

The rearward movement of the compressor disk 121 may be performed in reverse of the forward movement process. That is, the second biasing member 1440 is moved toward the adjusting part 1300, and the first biasing member 1430 is moved to be screwed into the insertion hole 1320. In this case, because the first biasing member 1430 biases the adjusting part 1300 rearward, and the second biasing member 1440 also biases the adjusting part 1300 rearward, the adjusting part 1300 is moved rearward. Further, the shaft 1100 and the compressor disk 121 are also moved rearward together with the adjusting part 1300.

Figure 9:
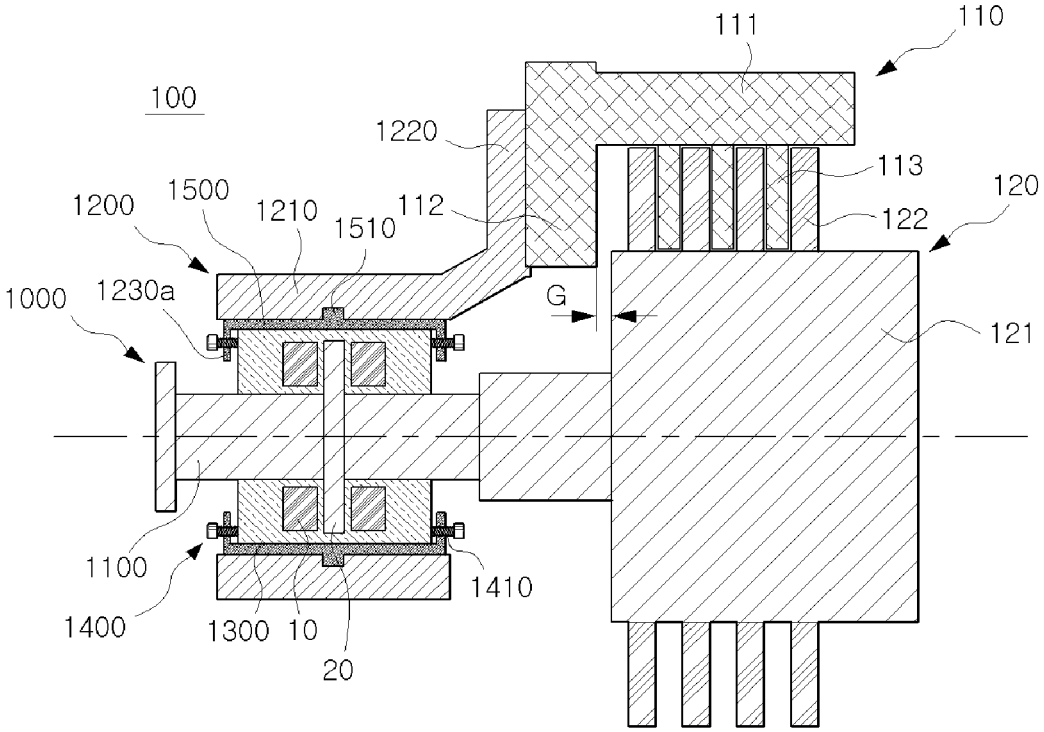
FIG. 9 is a view illustrating a gas turbine according to a fourth exemplary embodiment.
Figure 10:
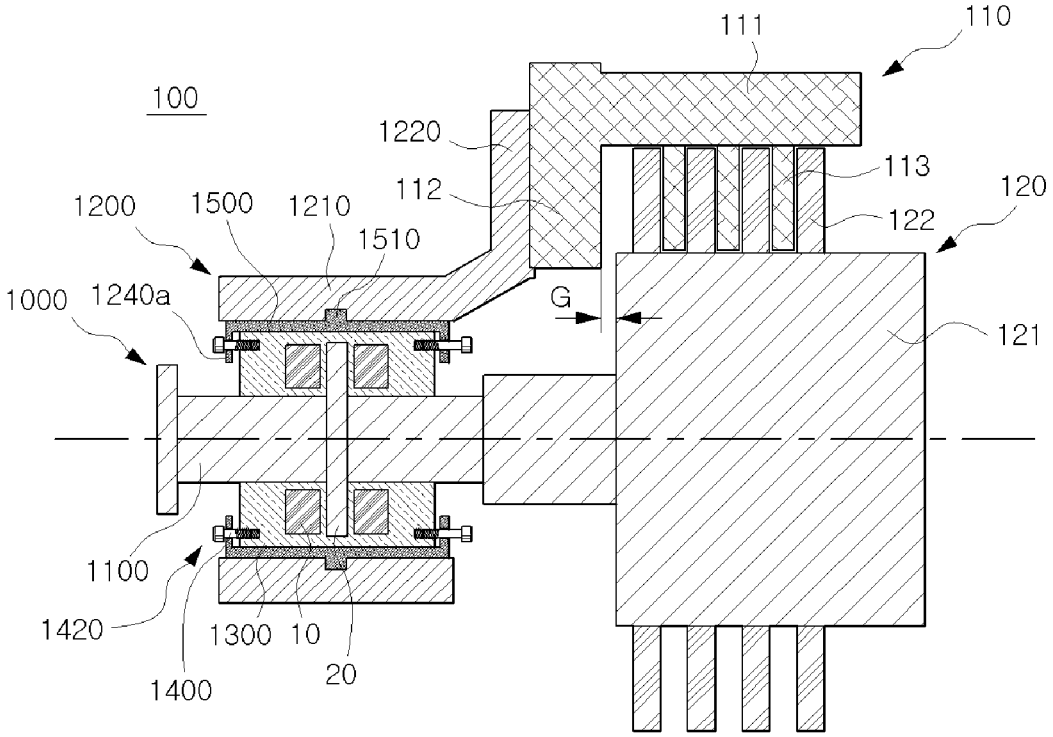
FIG. 10 is a view illustrating a gas turbine according to a fifth exemplary embodiment.
Figure 11:
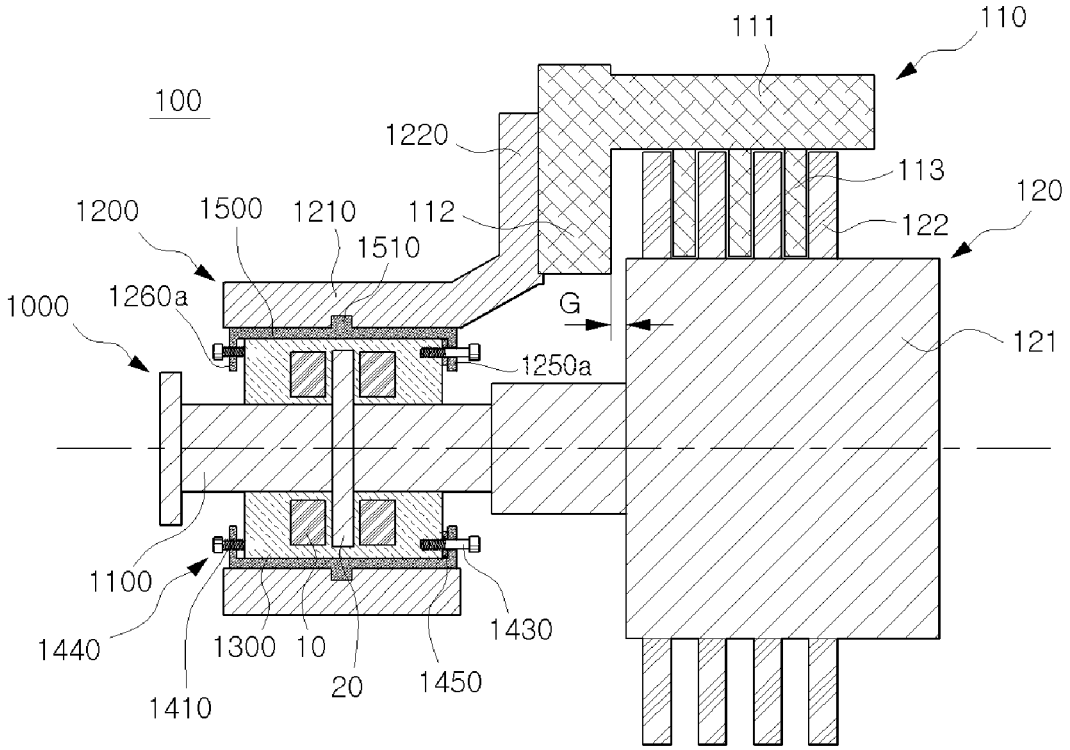
FIG. 11 is a view illustrating a gas turbine according to a sixth exemplary embodiment.

FIG. 9 is a view illustrating a gas turbine according to a fourth exemplary embodiment, FIG. 10 is a view illustrating a gas turbine according to a fifth exemplary embodiment, and FIG. 11 is a view illustrating a gas turbine according to a sixth exemplary embodiment.

Referring to FIGS. 9 to 11, the fastening part 1200 further includes a reinforcing housing 1500 having a reinforcing protrusion 1510. The reinforcing housing 1500 is disposed between the fastening housing 1210 and the adjusting part 1300. The reinforcing protrusion 1510 protrudes radially outward from an outer circumferential surface of the reinforcing housing 1500 such that the reinforcing protrusion 1510 is inserted into an inner circumferential surface of the fastening housing 1210. Therefore, the reinforcing housing 1500 is installed to be fixed in the front-rear direction with respect to the fastening housing 1210 by the reinforcing protrusion 1510.

For example, the pair of fastening steps 1230, 1240, 1250, and 1260 of FIGS. 3, 5 and 7 are formed to protrude radially inward from an inner circumferential surface of the reinforcing housing 1500, not from an inner circumferential surface of the fastening housing 1210. However, a pair of fastening steps 1230*a*, 1240*a*, 1250*a*, and 1260*a* of FIGS. 9 to 11 has the same shape and structure as the pair of fastening steps 1230, 1240, 1250, and 1260 of FIGS. 3, 5 and 7.

Referring to FIG. 9, similar to the pair of fastening steps 1230 of FIG. 3, the pair of fastening steps 1230*a* include a through-hole having a threaded portion on an inner surface thereof. Referring to FIG. 10, similar to the pair of fastening steps 1240 of FIG. 5, the pair of fastening steps 1240*a* include a through-hole without a threaded portion on an inner surface thereof. Referring to FIG. 11, similar to the pair of fastening steps 1250 and 1260 of FIG. 7, the pair of fastening steps 1250*a* and 1260*a* include a first fastening step 1250*a* and a second fastening step 1260*a*. In addition, the second fastening step 1260*a* includes a through-hole having a threaded portion on an inner surface thereof and the first fastening step 1250*a* includes a through-hole without a threaded portion on an inner surface thereof.

The clearance adjusting apparatus according to one or more exemplary embodiments can correct errors related to the initial installation position of the apparatus without separate disassembly and reassembly of parts.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A clearance adjusting apparatus disposed in front of a compressor of a gas turbine to axially move a compressor disk back and forth to adjust a tip clearance of the compressor, the clearance adjusting apparatus comprising:

a hollow fastening part disposed in front of a compressor casing;

a shaft disposed in the fastening part and coupled to a front side of a compressor disk;

an adjusting part disposed between the fastening part and the shaft to axially move the shaft back and forth to adjust the tip clearance; and a biasing part disposed on the fastening part to bias the adjusting part back and forth to adjust a position of the adjusting part and the shaft, wherein a protruding member is formed to protrude radially inward from an inner circumferential surface of a front side of the compressor casing, wherein the fastening part comprises:

a fastening housing installed around an outer circumferential surface of the adjusting part;

a fastening member disposed on a rear end of the fastening housing to be fixed to the protruding member; and a fastening step disposed on an inner circumferential surface of the fastening housing, wherein the biasing part is disposed on the fastening step to bias the adjusting part back and forth so that the adjusting part and the shaft are moved back and forth.

2. The clearance adjusting apparatus according to claim 1, wherein a gap is formed between the protruding member and the compressor disk in an axial direction of the compressor disk, and the biasing part is configured to adjust a position of the adjusting part and the shaft by biasing the adjusting part rearward if the gap is less than a preset reference range and biasing the adjusting part forward if the gap exceeds the preset reference range.

3. The clearance adjusting apparatus according to claim 1, wherein the fastening step includes a pair of fastening step portions spaced apart back and forth from each other, the adjusting part is disposed between the pair of fastening step portions, and the biasing part includes a pair of biasing members disposed to penetrate through the pair of fastening step portions from an outside toward an inside of the pair of the fastening step portions, respectively, in an axial direction thereof to bias and move the adjusting part forward or rearward.

4. The clearance adjusting apparatus according to claim 3, wherein the pair of biasing members are disposed to be movable back and forth with respect to the pair of fastening step portions, respectively, such that respective distal ends thereof comes into contact with front and rear surfaces of the adjusting part, and if one of the biasing members is moved toward and biases the adjusting part, the other biasing member is moved away from the adjusting part.

5. The clearance adjusting apparatus according to claim 4, wherein each of the pair of fastening step portions includes through-holes having a threaded portion on an inner wall thereof such that the pair of biasing members penetrate therethrough, and the pair of biasing members include a threaded portion to be meshed with the threaded portion of the through-hole on an outer circumferential surface thereof, so that the pair of biasing members rotate and move back and forth through the pair of fastening step portions, respectively.

6. The clearance adjusting apparatus according to claim 3, wherein the adjusting part includes a pair of insertion holes into which distal ends of the pair of biasing members are respectively inserted, and a threaded portion is formed on an inner wall of the through-hole, and the pair of biasing members which are rotatable at a fixed position with respect to the pair of fastening step portions include a threaded portion corresponding to the threaded portion of the pair of the insertion holes on an outer circumferential surface of the distal end side thereof, such that if one of the biasing members is screwed into one of the insertion holes, the other biasing member is unscrewed out of the other insertion hole.

7. The clearance adjusting apparatus according to claim 3, wherein the pair of fastening step portions include a first fastening step portion disposed on a rear side of an axial thrust direction based on the adjusting part and a second fastening step portion disposed on a front side of the thrust direction based on the adj us ting part, the adj us ting part being subjected to an axial thrust with a fluid flowing through the gas turbine, and the pair of biasing members include a first biasing member attached to the first fastening step portion and a second biasing member attached to the second fastening step portion, wherein the biasing part further includes a washer member fitted around the first biasing member between the adjusting part and the first fastening step portion.

8. The clearance adjusting apparatus according to claim 7, wherein the adjusting part includes an insertion hole into which a distal end of the first biasing member is inserted, and a threaded portion is formed on an inner wall of the through-hole, the first biasing member which is rotatable at a fixed position with respect to the first fastening step portion includes a threaded portion corresponding to the threaded portion of the insertion hole on an outer circumferential surface of the distal end side thereof, the second biasing member is movable back and forth with respect to the second fastening step portion such that a distal end thereof is arranged to contact the adjusting part, and if the second biasing member is moved toward and biases the adjusting part, the first biasing member is screwed into the insertion hole, and if the second biasing member is moved away from the adjusting part, the first biasing member is unscrewed out of the insertion hole.

9. A clearance adjusting apparatus disposed in front of a compressor of a gas turbine to axially move a compressor disk back and forth to adjust a tip clearance of the compressor, the clearance adjusting apparatus comprising:

a hollow fastening part disposed in front of a compressor casing;

a shaft disposed in the fastening part and coupled to a front side of a compressor disk;

an adjusting part disposed between the fastening part and the shaft to axially move the shaft back and forth to adjust the tip clearance; and a biasing part disposed on the fastening part to bias the adjusting part back and forth to adjust a position of the adjusting part and the shaft, wherein a protruding member is formed to protrude radially inward from an inner circumferential surface of a front side of the compressor casing, wherein the fastening part comprises:

a fastening housing installed around an outer circumferential surface of the adjusting part;

a fastening member disposed on a rear end of the fastening housing to be fixed to the protruding member; and a fastening step disposed on an inner circumferential surface of the fastening housing, wherein the biasing part is disposed on the fastening step to bias the adjusting part back and forth so that the adjusting part and the shaft are moved back and forth, wherein the fastening part further includes a reinforcing housing disposed between the fastening housing and the adjusting part, and a reinforcing protrusion protruding from an outer circumferential surface of the reinforcing housing to be inserted into an inner circumferential surface of the fastening housing, and the fastening step is formed to protrude from an inner circumferential surface of the reinforcing housing.

10. A gas turbine comprising:

a compressor including a compressor casing along which an externally introduced au flows, a compressor stator coupled to an inner circumferential surface of the compressor casing and having compressor vanes disposed in a multi-stage along a flow direction of the au, and a compressor rotor having a compressor disk disposed inside the compressor casing and compressor blades coupled to an outer circumferential surface of the compressor disk such that the compressor blades are disposed between the compressor vanes to rotate;

a combustor configured to mix the compressed air supplied from the compressor with fuel and combust the air-fuel mixture;

a turbine including a turbine stator through which the combustion gas supplied from the combustor flows and a turbine rotor disposed in the turbine stator to rotate with the combustion gas flowing therethrough; and a clearance adjusting apparatus disposed in front of the compressor to axially move the compressor disk back and forth to adjust a tip clearance formed between the compressor blade and the compressor casing, the clearance adjusting apparatus comprising:

a hollow fastening part disposed in front of the compressor casing;

a shaft disposed in the fastening part and coupled to a front side of the compressor disk;

an adjusting part disposed between the fastening part and the shaft to axially move the shaft back and forth to adjust the tip clearance; and a biasing part disposed on the fastening part to bias the adjusting part back and forth to adjust a position of the adjusting part and the shaft, wherein a protruding member is formed to protrude radially inward from an inner circumferential surface of a front side of the compressor casing, wherein the fastening part comprises:

a fastening housing installed around an outer circumferential surface of the adjusting part;

a fastening member disposed on a rear end of the fastening housing to be fixed to the protruding member; and a fastening step disposed on an inner circumferential surface of the fastening housing, wherein the biasing part is disposed on the fastening step to bias the adjusting part back and forth so that the adjusting part and the shaft are moved back and forth.

11. The gas turbine according to claim 10, wherein a gap is formed between the protruding member and the compressor disk in an axial direction of the compressor disk, wherein the biasing part is configured to adjust a position of the adjusting part and the shaft by biasing the adjusting part rearward if the gap is less than a preset reference range and biasing the adjusting part forward if the gap exceeds the preset reference range.

12. The gas turbine according to claim 10, wherein the fastening step includes a pair of fastening step portions spaced apart back and forth from each other, the adjusting part is disposed between the pair of fastening step portions, and the biasing part includes a pair of biasing members disposed to penetrate through the pair of fastening step portions from an outside toward an inside of the pair of the fastening step portions, respectively, in an axial direction thereof to bias and move the adjusting part forward or rearward.

13. The gas turbine according to claim 12, wherein the pair of biasing members are disposed to be movable back and forth with respect to the pair of fastening step portions, respectively, such that respective distal ends thereof comes into contact with front and rear surfaces of the adjusting part, wherein if one of the biasing members is moved toward and biases the adjusting part, the other biasing member is moved away from the adjusting part.

14. The gas turbine according to claim 13, wherein each of the pair of fastening step portions includes through-holes having a threaded portion on an inner wall thereof such that the pair of biasing members penetrate therethrough, and the pair of biasing members include a threaded portion to be meshed with the threaded portion of the through-hole on an outer circumferential surface thereof, so that the pair of biasing members rotate and move back and forth through the pair of fastening step portions, respectively.

15. The gas turbine according to claim 12, wherein the adjusting part includes a pair of insertion holes into which distal ends of the pair of biasing members are respectively inserted, and a threaded portion is formed on an inner wall of the through-hole, and the pair of biasing members which are rotatable at a fixed position with respect to the pair of fastening step portions include a threaded portion corresponding to the threaded portion of the pair of the insertion holes on an outer circumferential surface of the distal end side thereof, such that if one of the biasing members is screwed into one of the insertion holes, the other biasing member is unscrewed out of the other insertion hole.

16. The gas turbine according to claim 12, wherein the fastening step portions include a first fastening step portion disposed on a rear side of an axial thrust direction based on the adjusting part and a second fastening step portion disposed on a front side of the thrust direction based on the adjusting part, the adjusting part being subjected to an axial thrust with a fluid flowing through the gas turbine, and the pair of biasing members include a first biasing member attached to the first fastening step portion and a second biasing member attached to the second fastening step portion, wherein the biasing part further includes a washer member fitted around the first biasing member between the adjusting part and the first fastening step portion.

17. The gas turbine according to claim 16, wherein the adjusting part includes an insertion hole into which a distal end of the first biasing member is inserted, and a threaded portion is formed on an inner wall of the through-hole, the first biasing member which is rotatable at a fixed position with respect to the first fastening step portion includes a threaded portion corresponding to the threaded portion of the insertion hole on an outer circumferential surface of the distal end side thereof, the second biasing member is movable back and forth with respect to the second fastening step portion such that a distal end thereof is arranged to contact the adjusting part, and if the second biasing member is moved toward and biases the adjusting part, the first biasing member is screwed into the insertion hole, and if the second biasing member is moved away from the adjusting part, the first biasing member is unscrewed out of the insertion hole.

18. The gas turbine according to claim 10, wherein the fastening part further includes a reinforcing housing disposed between the fastening housing and the adjusting part, and a reinforcing protrusion protruding from an outer circumferential surface of the reinforcing housing to be inserted into an inner circumferential surface of the fastening housing, and the fastening step is formed to protrude from an inner circumferential surface of the reinforcing housing.

* * * * *